US007021688B1

(12) United States Patent
Glynn

(10) Patent No.: US 7,021,688 B1
(45) Date of Patent: Apr. 4, 2006

(54) TEST CORE CLAMP

(76) Inventor: Timothy Dale Glynn, 24600 Flanders St., Dowagiac, MI (US) 49047

( * ) Notice: Subject to any disclaimer, the term of this patent is extended or adjusted under 35 U.S.C. 154(b) by 254 days.

(21) Appl. No.: 10/201,059

(22) Filed: Jul. 22, 2002

(51) Int. Cl.
*B66C 1/42* (2006.01)

(52) U.S. Cl. ..... 294/119.2; 269/270

(58) Field of Classification Search ..... 294/15, 294/16, 28, 31.2, 33, 50, 50.5, 50.7, 90, 91, 294/119.2; 73/864.44, 864.45, 864.51; 269/254 R, 269/268, 270; 144/286.1, 286.5
See application file for complete search history.

(56) References Cited

U.S. PATENT DOCUMENTS 1,553,665 A * 9/1925 Bergsten ..... 294/90
2,593,924 A * 4/1952 Rothkamm ..... 294/50.7
2,863,258 A * 12/1958 Gish ..... 294/50.7
2,989,335 A * 6/1961 North ..... 294/50.7
2,994,551 A * 8/1961 Garnett, Jr. ..... 294/90
3,284,932 A * 11/1966 Wendlandt ..... 294/50.7
3,471,192 A * 10/1969 Child et al. ..... 294/50.7
3,817,435 A * 6/1974 De Luca et al. ..... 294/165
4,154,435 A * 5/1979 Alessio ..... 269/139
4,770,336 A * 9/1988 Arterbury et al. ..... 166/227
5,044,236 A * 9/1991 Mills ..... 83/29
5,328,221 A 7/1994 Richardson
5,366,317 A * 11/1994 Solimar ..... 411/98
5,431,466 A 7/1995 Richardson
6,591,724 B1 * 7/2003 Huang ..... 269/303
2003/0168870 A1 * 9/2003 Spencer et al. ..... 294/50.7

* cited by examiner

*Primary Examiner*—Eileen D. Lillis
*Assistant Examiner*—Paul T. Chin

(57) ABSTRACT

A test core clamp comprising a first longitudinally split tube comprising a split portion having opposing ends and attached to a base, and a tightening device for moving the opposing ends towards each other. The tightening device comprises two brackets one affixed to each of the opposing ends and both having apertures therein. One of the bracket apertures is threaded to engage one end of a clamping bolt inserted through and rotating freely within the other bracket aperture such that rotation of the clamping bolt causes the opposing ends to close or open. According to a preferred embodiment, an insert comprising a second longitudinally split tube having a plurality of fins extending radially from its outer surface is slideably located inside of the first split tube with the fins frictionally engaging the inner surface of the first split tube such that closing and opening of the first split tube results in opening and closing of the second split tube.

5 Claims, 4 Drawing Sheets

TEST CORE CLAMP

FIELD OF THE INVENTION

The present invention relates to clamping devices and more particularly to clamping devices used in the clamping of test core samples for sawing or cutting.

BACKGROUND OF THE INVENTION

There are innumerable civil engineering, archeological and geological areas where so-called test core sampling is applied. Such sampling generally involves the extraction of a "core" i.e. a round sample drilled from or to a depth in an area to be studied. One such area of use of core samples is in the application of macadam or black top and concrete to highways, parking lots and the like. It is conventional practice for the "owner" of the surface to be finished, such as an individual state or the Federal Government to specify the density of application of such surfaces. In such cases, after macadam application and compacting, a "test core" or round sample is extracted from the applied surface and its density measured against the density specification. In such situations, the core sample may vary in diameter from as little as 2 inches upwards to as much as 10 inches, although samples of from 2 to 6 inches are more the norm. Typical devices for extracting such test cores are described in U.S. Pat. Nos. 5,328,221 and 5,431,466.

In situations where a new surface is being applied over an old or existing surface, it is common to have some portion of the preexisting surface adhere to the bottom of the test core at extraction. In order that an accurate density measurement of the newly applied surface be obtained, it is necessary that the portion of the older/existing surface be cut from the newly installed surface. Such an operation requires the placement of the round core under an appropriate saw and cutting with the saw. It is conventional practice to have a technician simply hold the unwieldy round sample by hand during the cutting operation. This is clearly a dangerous operation and has resulted in the accidental removal of more than a few fingers causing pain and suffering to the technician and cost to the owner of the testing facility.

It would therefore be highly desirable to have a clamping device that firmly and securely held the test core under the saw during the sawing operation to avoid such accidents and to provide a more accurate cut than can be obtained when the test core is held by hand.

OBJECTS OF THE INVENTION

It is therefore an object of the present invention to provide a clamping device that firmly and accurately holds a test core during sawing.

It is another object of the present invention to provide such a clamping device that can quickly and easily be adapted to hold test cores of differing diameter.

SUMMARY OF THE INVENTION

According to the present invention there is provided a test core clamp comprising a first longitudinally split tube comprising a split portion defined by opposing ends attached to a base, and a tightening device for moving the opposing ends towards each other. The tightening device comprises two brackets one affixed to each of the opposing ends and both having apertures therein. One of the bracket apertures is threaded to engage one end of a clamping bolt inserted through and rotating freely within the other bracket aperture such that rotation of the clamping bolt in one direction causes the opposing ends to close or move toward each other and rotation in the other direction causes the opposing ends to move away from each other. According to a preferred embodiment, an insert comprising a second longitudinally split tube having a plurality of fins extending radially from its outer surface is located inside of the first split tube with the fins frictionally engaging the inner surface of the first split tube such that closing and opening of the first split tube results in opening and closing of the second split tube. According to a further preferred embodiment the threaded bracket includes a grease fitting to permit lubrication of the clamping bolt at the points where it engages the threaded bracket.

DETAILED DESCRIPTION

Figure 1:
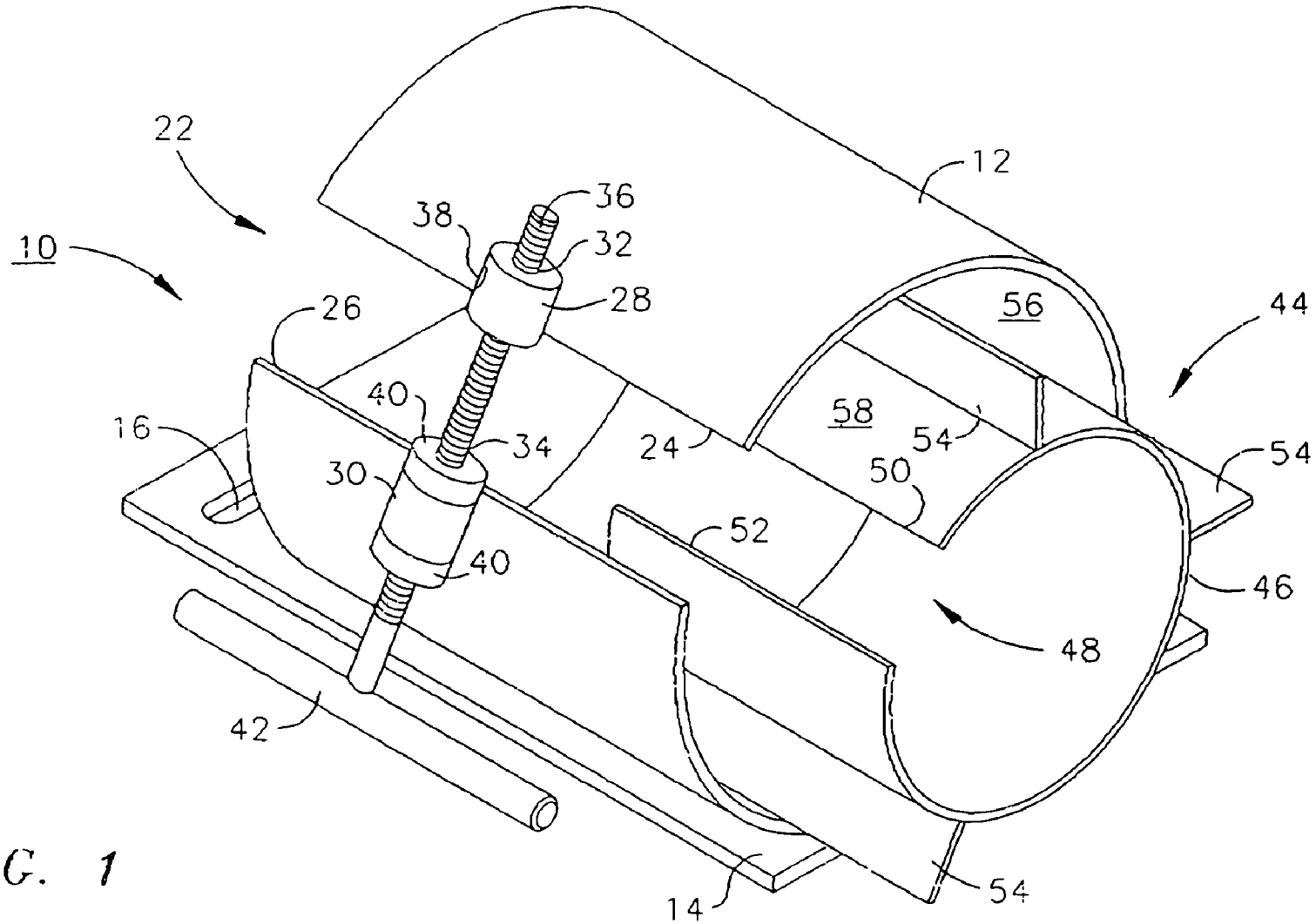
FIG. 1 is a perspective view of a preferred embodiment of the test core clamping device of the present invention.
Figure 5:
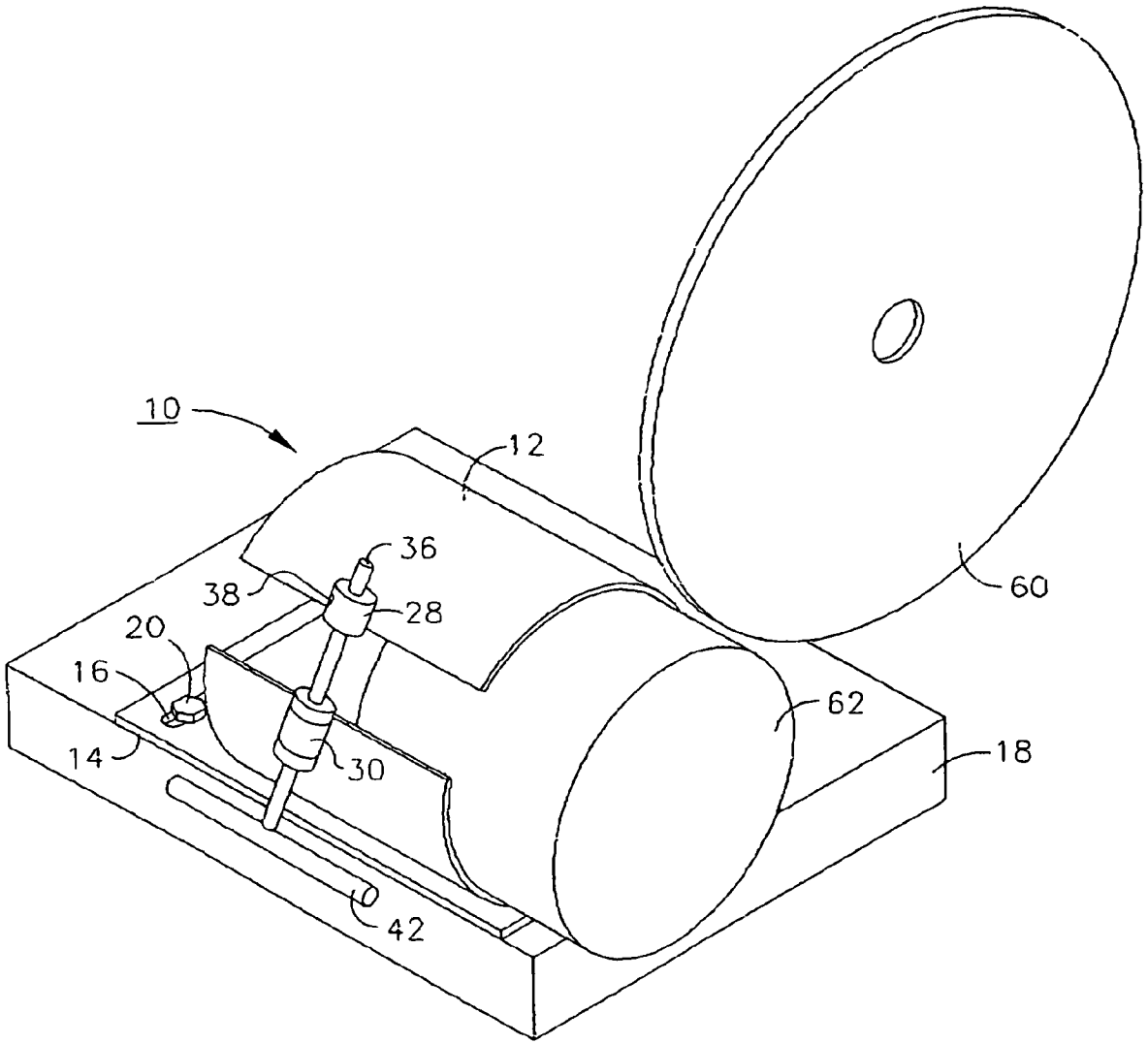
FIG. 5 is a perspective view showing the test core clamping device of the present invention as it would be used to retain a test core for sawing.

Referring now to FIG. 1, the test core clamping device of the present invention 10 comprises a first split tube 12 attached to a base 14 having mounting hole(s) 16 (only one is visible in the depiction of FIG. 1) therein for attachment of base 14 to a saw bed 18 by, for example, bolts 20 (shown in FIG. 5).

Figure 2:
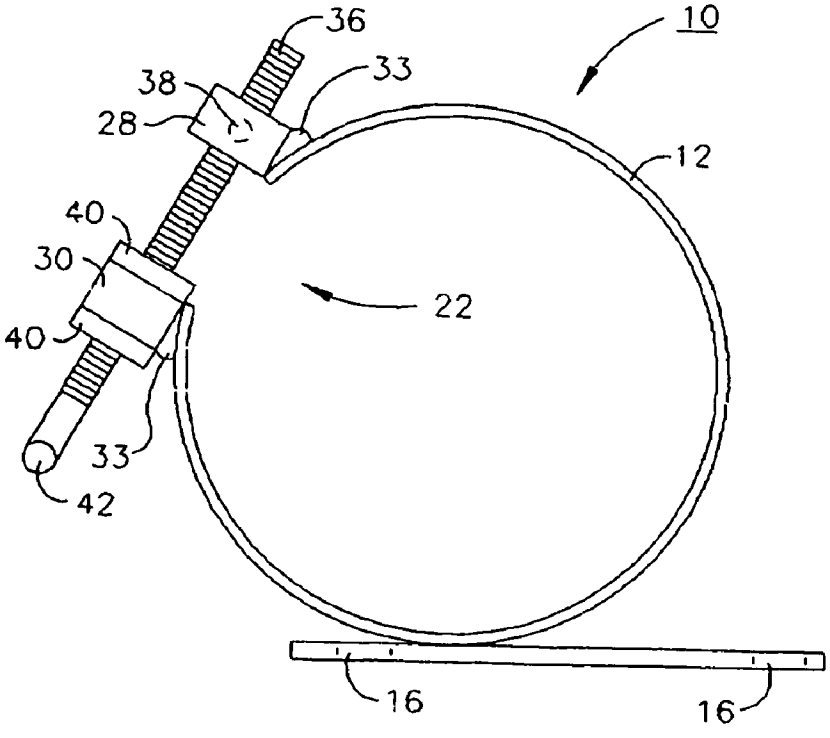
FIG. 2 is an end view of the test core clamping device of the present invention without an insert.

Split portion 22 is defined by opposing ends 24 and 26. Attached by welds 33 (see FIGS. 2 and 3) or other suitable means to first split tube 12 in the vicinity of each of opposing ends 24 and 26 are brackets 28 and 30. Bracket 28 has a threaded aperture 32 therein while bracket 30 has an aperture 34 that is sufficiently large as to permit passage of threaded bolt 36 therethrough without engagement. Bracket 28 is preferably equipped with a grease fitting 38 to permit greasing of the engaging threads of aperture 32 and threaded bolt 36 as devices of this type are commonly used and stored out of doors. In the embodiment depicted in the Figures, bracket 30 retains threaded bolt 36 by the permanent attachment of a pair of washer-like structures 40 to threaded bolt 36 at the opposite ends of aperture 34, thereby retaining threaded bolt 36 in bracket 30. A handle 42 of any suitable type is attached to one end of threaded bolt 36 to permit easy turning of threaded bolt 36. Thus, while a T-shaped handle is shown some other configuration of handle 42 is equally useful as long as it provides a means for rotation of threaded bolt 36. As will be apparent to the skilled artisan, rotation of threaded bolt 36 in one direction will result in opening of first slit portion 22 while rotation in the other direction will result in closing of split portion 22 as opposing ends 24 and 26 are drawn toward each other or pushed away from each other through the action of threaded bolt 36.

Figure 3:
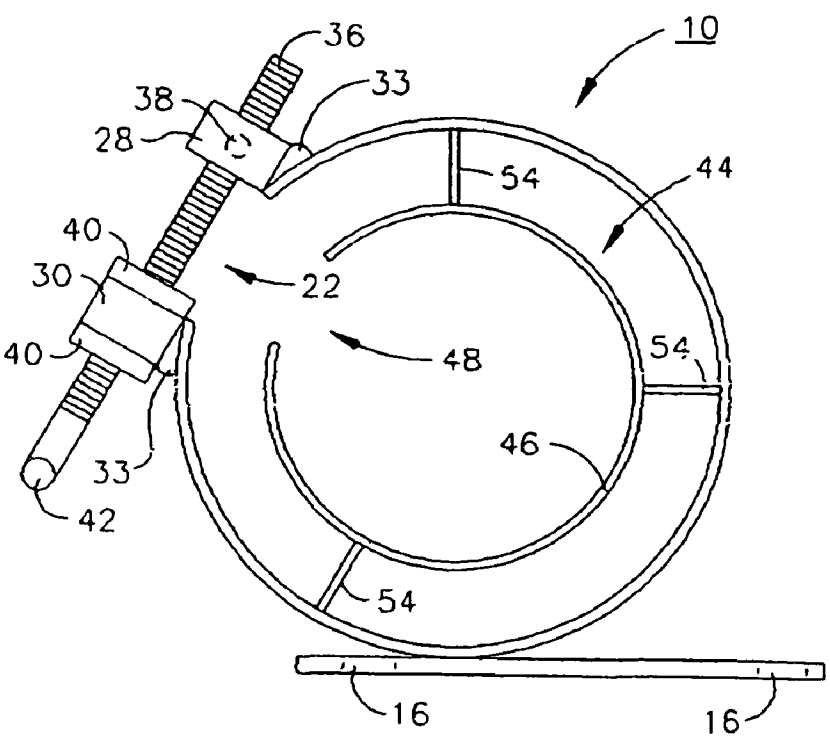
FIG. 3 is an end view of the test core clamping device of the present invention with an insert.
Figure 4:
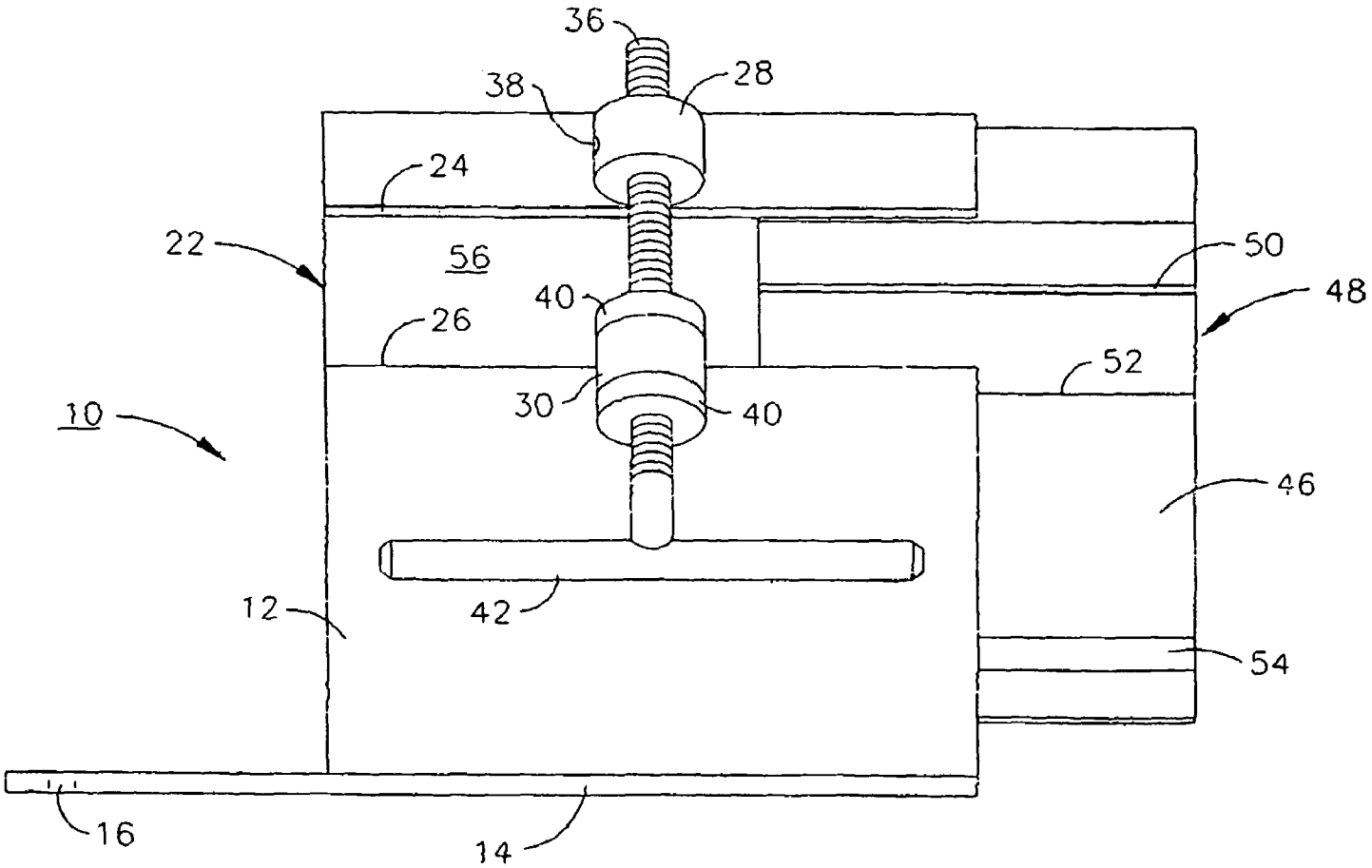
FIG. 4 is a front view of the test core clamping device of the present invention as depicted in FIG. 1.

According to the preferred embodiment of the test core clamping device depicted in FIGS. 1, 3 and 4 an insert 44 comprising a second split tube 46 having a second split portion 48 defined by opposing ends 50 and 52 and radially extending fins 54 about its outer surface 58 is inserted into the interior of first split tube 12 such that radially extending fins 54 frictionally engage interior wall 56 of first split tube 12. As will be apparent to the skilled artisan, this configuration permits the closing and opening of split portion 48 with the rotation of threaded bolt 36 at such rotation causes opening and closing of split portion 22 in first split tube 12. In this embodiment, a test core of a smaller diameter than the diameter of first split tube 12, i.e. of the smaller diameter of second split tube 46 can be held using the test core clamping device of the present invention. The use of insert 44 or a variety of inserts 44 allows for the cutting of test cores of a variety of diameters without the removal of the test core clamping device from saw bed 18. While three radially extending fins 54 are shown in the various Figures, it will be apparent to the skilled artisan that any suitable number of fins may be used as long as insert 44 is securely mounted within split tube 12. Three fins 54 would be the minimum for such secure containment of a test core.

The use of test core clamping device 10 is best illustrated by reference to FIG. 5. As shown in this Figure, base 14 is attached to saw bed 18 appropriately located with reference to saw blade 60. It is highly desirable that saw bed 18 be a moveable bed that reciprocates under saw blade 60 for easy movement of test core clamping device 10 and contained test core sample 62 under saw blade 60.

Test core clamping device 10 may be fabricated from any suitable material such as a metal, steel or a suitable polymeric material that exhibits the appropriate tendency to retain its shape after deformation by the action of threaded bolt 36. Specifically preferred as the material of fabrication is powder coated (to resist corrosion) cold rolled steel.

As the invention has been described, it will be apparent to those skilled in the art that the same may be varied in many ways without departing from the intended spirit and scope of the invention, and any and all such modifications are intended to be included within the scope of the appended claims.

What is claimed is:

1. In combination:

A) a saw bed; and

B) a test core clamping device comprising:

i) a longitudinally split tube including a split portion defined by opposing edges;

ii) a longitudinal base to which said longitudinally split tube is attached along its length; and iii) a tightening device comprising:

a) a first threaded bracket affixed in the vicinity of one of said opposing edges;

b) a second bracket affixed in the vicinity of the other of said opposing edges;

c) a threaded clamping bolt inserted through, rotating freely within and longitudinally fixed to said second bracket such that rotation of said clamping bolt in one direction causes said opposing ends to move apart and rotation of said clamping bolt in the opposite direction causes said opposing ends to move toward each other, said test core clamping device being removably attached to said saw bed; and d) an insert comprising a second longitudinally split tube having an exterior periphery, a split portion defined by second opposing ends and a plurality of fins extending radially from said exterior surface such that when said insert is slideably placed inside of said first longitudinally split tube said fins frictionally engage said interior surface.

2. The combination of claim 1 further including a handle mechanism on said clamping bolt to facilitate rotation thereof.

3. The combination of claim 2 further including a mechanism for greasing said first bracket.

4. The combination of claim 1 further including an aperture in said base for attaching said base to said saw bed.

5. The combination of claim 1 wherein said saw bed is movable under a saw operatively arranged therewith.

* * * * *